United States Patent [19]

Dale

[11] 4,323,321

[45] Apr. 6, 1982

[54] TRACK DRIVEN MACHINES WITH AUXILIARY CABLE-WINCH DRIVE

[75] Inventor: Charles H. Dale, Rock Island, Ill.

[73] Assignee: Pav-Saver Mfg. Co., East Moline, Ill.

[21] Appl. No.: 144,296

[22] Filed: Apr. 28, 1980

[51] Int. Cl.[3] ..... E01C 19/12

[52] U.S. Cl. ..... 404/105; 180/306

[58] Field of Search ..... 404/105, 84, 101, 106, 404/102, 108, 133, 83, 98; 180/311, 306

[56] References Cited

U.S. PATENT DOCUMENTS

| | | | |
|---|---|---|---|
| 1,265,499 | 5/1918 | Parrish | 404/133 |
| 1,447,999 | 3/1932 | Rathmell | 404/133 |
| 1,495,901 | 5/1924 | French | 404/133 |
| 3,250,340 | 5/1966 | Roberson | 180/306 X |
| 3,318,208 | 5/1967 | Durston | 404/102 |
| 3,377,933 | 4/1968 | Dale | 404/106 X |
| 3,435,740 | 4/1969 | McGall | 404/119 X |
| 3,477,354 | 11/1969 | Rink | 404/105 X |
| 3,905,715 | 9/1975 | Dale | 404/84 |
| 4,249,327 | 2/1981 | Allen | 404/119 X |

*Primary Examiner*—Nile C. Byers, Jr.

*Attorney, Agent, or Firm*—Matthew C. Thompson

[57] ABSTRACT

Track driven machines useful in slip form and other road paving operations embodying a support frame, with hollow frame members serving as cooling reservoirs for hydraulic fluid, supported by hydraulic cylinders on a pair of power driven, endless tracks. The frame is maintained in a pre-oriented plane as the machine moves along terrain by a hydraulic fluid control system operating cylinders in response to torsion bar-registered twist of the frame, string-line feeler means and a level controller. Two winches driven by respective hydraulic motors are mounted ahead of each track. Cables wound thereon may be attached to stationary objects to provide auxiliary forward drive(s) for each track, or in emergencies as the replacement drive for a disabled track.

10 Claims, 8 Drawing Figures

TRACK DRIVEN MACHINES WITH AUXILIARY CABLE-WINCH DRIVE

THE IMPROVEMENTS

The invention herein relates to improvements for trackdriven road-paving machines of the type disclosed in my U.S. Pat. No. 3,905,715, issued Sept. 16, 1975. The improvements reside in at least one auxiliary winch mounted on the front part of the machine and driven by a hydraulic motor coupled hydraulically to the hydraulic system used also to drive the endless tracks. A cable wound on the winch may be attached to a stationary object ahead of the machine (e.g., an abutment, a ground-secured post, a heavy truck or piece of paving or road grading machinery, a crane or power shovel, etc.), and the winch(es) are rotated by its/their hydraulic motor(s) to draw the machine forwardly—usually simultaneously with the tracks also being driven by their hydraulic motors. The overall hydraulic drive-control system for the tracks and the winch(es) provides coaction between the cable/winch(es) auxiliary drive and the main drive provided by the tracks so that each side of the machine moves forwardly as desired, e.g., under the guidance provided by string line feelers used on slip form paving machines as described in my U.S. Pat. No. 3,905,715.

An example of times when both the cable/winch(es), auxiliary drives and the track drive are used together are situations in which one or both tracks slip on the underlying terrain and do not provide steady, controlled forward drive of the slip-form road paving machine. Another situation is one in which the machine is widened to paving widths which provide unusually heavy loads of wet concrete being pushed and worked by the paver that the tracks do not have enough traction to push the heavy load ahead of the strike-off plate and drive the machine forwardly over the struck-off layer of concrete.

Also, if one track becomes disabled, the cable/winch drive may be used to drive the side of the machine with the disabled track. The hydraulic line to the hydraulic motor of the disabled track is closed by a valve or disconnected and blocked. The mechanical drive between the track and the motor is disconnected to that the track is free to move. The hydraulic motor for the cable/winch on this side of the machine is then activated to drive forwardly under manual or automatic control the disabled-track-side of the machine while the other side of the machine is driven forwardly under manual or automatic control by its track, or the working track and its cable/winch auxiliary drive. This option is very useful where wet concrete has been dumped from concrete trucks or on-site cement mixers ahead of the machine just before the disablement and/or concrete trucks with undumped loads cannot be diverted to other pouring sites.

Another improvement of this invention is the utilization of hollow, tubular frame members of the machine as reservoirs for the hydraulic fluid used by the various components of the machine. In use, the hydraulic fluid heats up. The tubular frame members have relatively large exposed surfaces per unit volume of fluid therein and thus improve rates of cooling of the heated hydraulic fluid.

PRIOR ART

The track driven machines, especially the slip form paving machines, herein disclosed as the illustrated, preferred embodiments of the invention are for the most part disclosed in my U.S. Pat. No. 3,905,715, the disclosure and drawings of which are incorporated herein by reference. My U.S. Pat. No. 3,377,333 discloses, inter alia, form paving machines which are propelled forwardly, with the crown pan slidably resting on a pair of pre-laid, parallel forms, by individually controllable winches, each having a cable wound thereon. The extended cables are anchored to the forms ahead of the paving machine. Speed and direction of forward travel (straight or curved) is controlled by the rate of rotation of the respective winches and rate of take-up of the anchored cables on their respective winches.

Further, some heavy duty trucks have a cable/winch unit mounted on the front of the vehicle. Occasionally, the unit is used to move the truck forwardly, e.g., when wheel traction is inadequate to move the vehicle from its stalled position.

THE TRACK DRIVEN MACHINES IN GENERAL

Preferred embodiments of the track driven machines on which the improvements herein are provided are disclosed in my aforesaid U.S. Pat. No. 3,905,715. These machines are ones in which a support frame is moved along terrain by a pair of power driven, endless, tracks mounted on respective sides of the frame. The track support structures are connected to the respective sides of the frame by mechanical coupling means keeping the frame and tracks together while allowing vertical movement of the frame relative to the tracks. At least one corner of the frame is suspended on a track by a hydraulic cylinder. Preferably there are two hydraulic cylinder members on each side of the frame—a total of four cylinder members in a quadrant arrangement—each supporting its adjacent part of the frame. The four cylinders constitute the sole, or at least the principal, means of support of the weight of the frame on the two tracks. The hydraulic cylinder mounting on the frame allows the frame to "float" through a predetermined path irrespective of up and down movement of the tracks as they pass over irregular terrain.

The floating effect for the frame is achieved by utilization of hydraulic fluid pressurizing means connected by hydraulic fluid lines to respective hydraulic cylinder members in combination with electro-hydraulic fluid control means operatively associated with a torsion bar which is rigidly connected at one end thereof to the frame, string line feelers, and preferably also a slope control unit. The torsion bar is adapted to register twisting forces in the frame means as the machine moves along irregular terrain. Such twisting forces occur when one track begins to rise or fall relative to the other track. At this point, the torsion bar-registered twisting of the frame is translated by a mechanical linkage to a switch in the electro-hydraulic fluid control means. The latter operates a hydraulic cylinder to raise or lower a corner or segment of the frame in the direction to relieve the twisting forces therein.

Thus, as the machine moves along irregular terrain, the torsion bar-hydraulic fluid control system maintains the frame in an essentially twist-force-free condition by moving one segment or corner of the frame up or down in a twist-force-relieving direction.

The machines have in the hydraulic control system other controls which may be used to operate the remaining hydraulic fluid cylinders. Preferably the torsion bar-registered twist in the frame is used to operate only one of the four cylinders. The other cylinder on the same side of the machine may also operate in response to torsion-bar registered twist, but preferably this cylinder is activated by a hydraulic fluid control means operatively associated with another type of control which maintains a predetermined position or elevation of one side of the frame relative to the other side of the frame. Such a control expediently, particularly in road paving machines having means mounted on the frame for spreading and laying a strip of road paving machine on a road bed surface, is an adjustable or fixed level control which is responsive to the angle of the horizontal plane of the frame relative to true horizontal. This control can be preset at zero or any indicated small angle relative to true horizontal so that the cylinder controlled thereby will raise or lower its side of the frame relative to the opposite side of the frame to maintain the desired horizontal orientation of the frame relative to true horizontal.

The weight distribution on the opposite side of the frame is supported on its track, either wholly or partially, by two additional hydraulic cylinder members spaced axially along the track in a manner providing a substantially quadrant arrangement in the four cylinders. In lesser refined forms, such hydraulic cylinder support for the opposite side of the frame may be dispensed with in favor of rigid connection of the opposite side of the frame to its track, augmented by partial, or replaced by, spring supported suspension of the opposite side, and the like.

In more refined forms, however, and particularly in the machines used for road paving and for other road building purposes, the opposite side of the frame is supported as aforesaid by two additional hydraulic cylinder members. These cylinder members are articulated, either jointly or severally, by one or two elevation control means—an embodiment of which are string-line feelers having horizontal arms which follow a string line set at predetermined elevations along the side of the roadway being laid. These string-line feelers activate a further hydraulic control system to cause the opposite side of the frame to move in a path corresponding to the elevations of the string line and independently of actual up and down movement of the corresponding track as it travels along the road bed surface or the terrain adjacent thereto.

The combination of the four hydraulic cylinders and their controls as aforedescribed keep the frame of a road paving machine in a predetermined horizontal plane and at predetermined elevations as the paving machine moves forwardly along a road bed. One form of paving machine for which the subject invention is particularly adaptable is a slip form paving machine which operates off a string line and lays road paving material, e.g., low slump concrete, without the need for prelaying of forms along the road bed surface. The frame of the slip form paving machine in turn supports one or more members which spread, compact, smooth, and/or finish the wet concrete into a strip of predetermined thickness, elevation and/or slope. For example, the frame may have supported thereon a transversely extending auger or augers which rough-spread piles of concrete dumped on the road bed. Such auger or augers normally project forwardly from the main frame of the machine. Following the auger unit, there may be a series of transversely spaced vibrators which extend into the wet concrete to impart thereto a compacting and/or settling effect. Another concrete working device supported by the main frame of the machine, either directly or indirectly, is a tamping bar which reciprocates vertically into the rough-spread wet concrete to further compact it into a layer of substantially uniform composition and/or work heavier aggregate near the surface of the layer more deeply into the layer.

A further concrete working member is a strike-off plate or member having a lower edge or surface adapted to shape the upper surface of the rough-spread concrete into the actual or approximate plane of the road surface—such plane having either a flat configuration or a crowned configuration.

All of these concrete working units or members operate between a pair of slip forms respectively mounted near to and parallel with the tracks of the machine. These slip forms principally comprise horizontally elongated plates or other flat surfaces lying in respective vertical planes. As the other parts of the machine work the concrete and shape its upper surface, the slip forms retain the concrete in the lateral direction of spread and ultimately shape the sides of the finished concrete strip left behind the machine as it progresses along the road bed.

The ultimate shape, elevation, and horizontal orientation of the upper surface of the finished concrete strip is determined principally by the positions assumed by a horizontal finishing pan or sheet, herein called a crown pan, and vertical slip form plates attached to opposite sides of the crown pan and depending therefrom. The pan in turn is supported by and below the "floating" frame of the machine. The longitudinal direction for the finished concrete strip is determined principally by the path taken by the two tracks. Control of the track drives may be done manually, but preferably is done off the same string line by a string-line feeler having a vertical arm which lies against the string line. Thus a machine is capable of operating almost automatically off a string line in the laying of a roadway strip having the designed vertical elevations and longitudinal path previously laid out by the string line extending along one side of the projected road bed. When such string lines are laid out by surveying instruments, precision rough-grading and/or finished grading of the roadway bed is of lesser criticality than in cases where other pavement laying techniques are used, e.g., form-paving between prelaid pavement-forming rails or plates. Even with relatively irregular rough-grading, the tracks of the machines can move over the relatively rough grading without adverse effect upon the ultimate actual elevation, shape or direction of the roadway which is laid.

A further advantage of the machines embodying the aforesaid hydraulic cylinder support of the frame on the tracks and the torsion bar-actuated control system, with or without the slope control system and/or the string-line control system, is the ability to drive the machine over rough, ungraded terrain, ditches, or other terrain irregularities.

In trucking road paving machines to and from the road sites the machines are often loaded or unloaded at points remote from the road bed and must move under their own power between the truck and road bed. Similarly, the machines may be called upon to move under their own power on non-road bed terrain either for parking purposes or changing sites along the road bed.

In such movements, the machine encounters irregular terrain, ditches, etc. which it must move across without loss of track traction, tipping, excess strain on the machine frame, etc. The machines allow the two tracks to pivot in a vertical plane relative to the frame and independently of each other, the extremes of which are orientations with one track sloping downwardly and the other sloping upwardly due to terrain conditions. Even such orientations do not impart excess twist strains to the frame of the machine because of the intermediary support of the frame by the torsion bar-controlled hydraulic cylinder, whose extension and/or retraction responds to the orientation of the individual tracks and keeps the frame in a relatively stable plane substantially free of excess twist strain.

PREFERRED EMBODIMENTS

Preferred embodiments of the invention are illustrated in the accompanying drawings, wherein.

Figure 1:
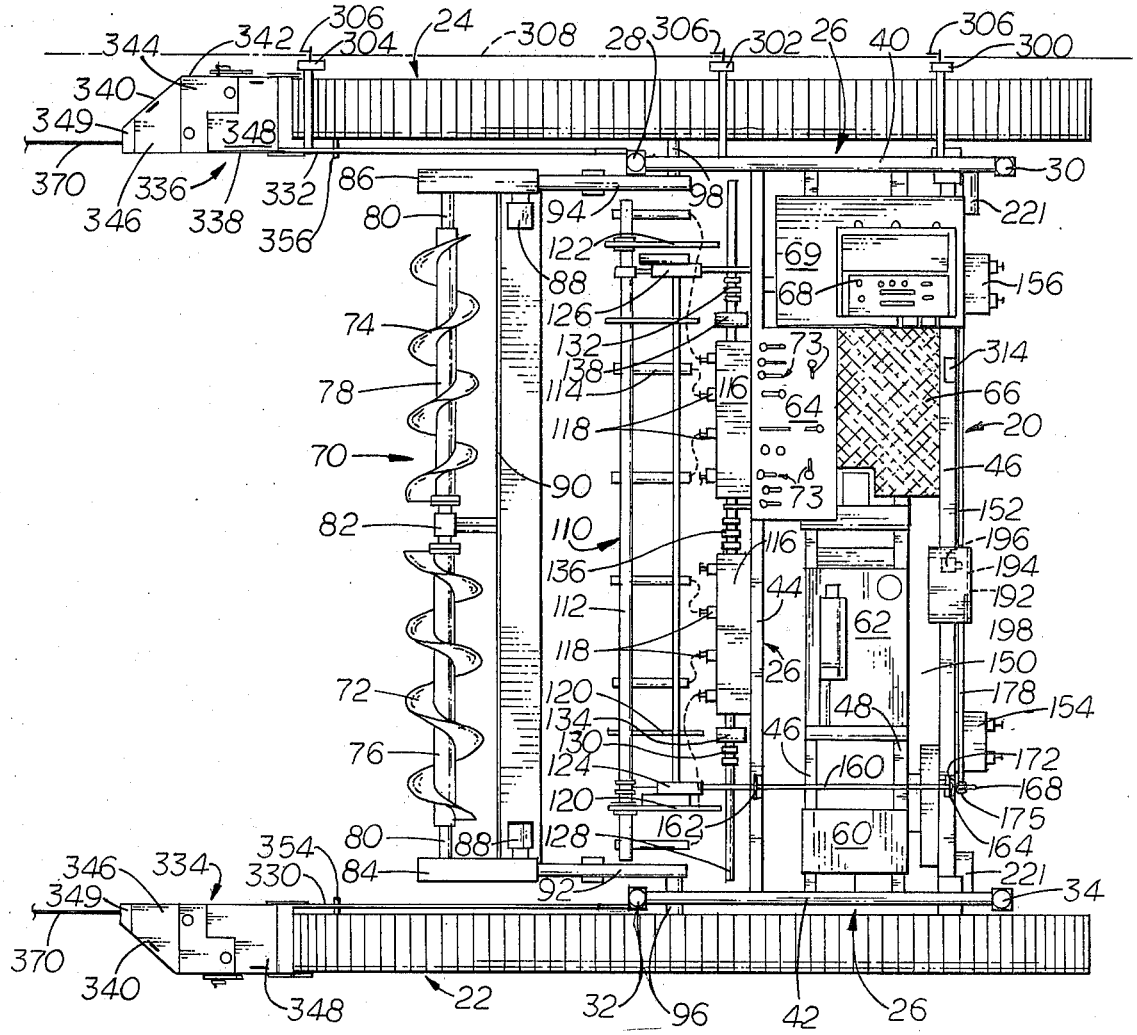
FIG. 1 is a top plan view of a slip form paving machine with two cable/winch auxiliary drives.

Referring to the drawings, the preferred embodiment of the invention is a slip form paving machine 20. It has a first endless track means 22 and a second endless track means 24 extending along and projecting forwardly and rearwardly beyond opposite sides of the main frame 26 of the machines. The first track means 22 and the main frame 26 are connected by hydraulic cylinder members 28 and 30, which members elongate and contract in the vertical direction. The second track means 24 is connected with the opposite side of the frame 26 by similar hydraulic members 32 and 34.

The main support frame 26 for the machine comprises a first side rectangular tube 40 and a second side rectangular tube 42; a front cross frame member 44; and a rear cross frame member 46. These beams may be of any construction meeting the requisite strength requirements, e.g., I-beams, heavy plates, angle irons, cylindrical or rectangular tubes, or composites thereof. When used as hydraulic fluid cooling reservoirs, they preferably are tubular.

Figure 2:
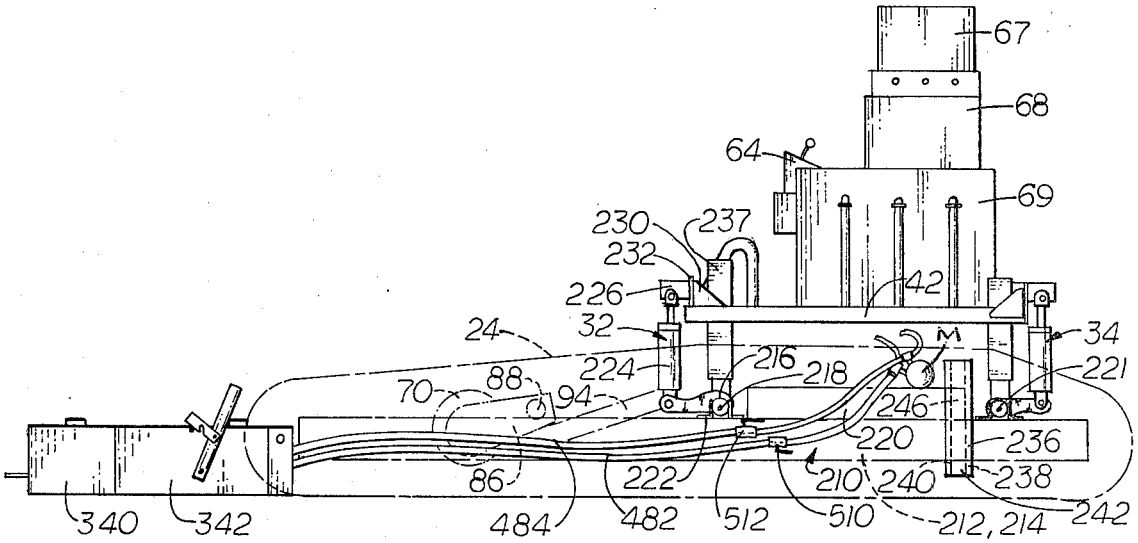
FIG. 2 is a semi-diagrammatic side elevation of said paving machine.

The main support frame 26 carries the power and drive components and the concrete working components of the machine. Referring to FIGS. 1 and 2, these components include a combustion engine powered power plant, i.e., the diesel driven power plant 62; a direct current generator 60; a control console 64; an operator platform 66; an electro-hydraulic control unit 68 with a hinged cover 67, which control unit is mounted on the hydraulic fluid reservoir tank 69.

The concrete working and finishing components of the machine are also supported on the main frame or, in some cases, by the frame structure for the track means 22 and 24. The concrete working components include a spreading auger 70 located forwardly of the main frame 26 and preferably between the track means 22 and 24. This auger is composed of two independently driven sections, each having a helical flight 72 and 74 of the same or opposite hand. The helical flights are mounted on hub tubes 76 and 78, which in turn are rotatably driven separately by the split shaft 80. This shaft is supported in the center bearing 82 and also in the chain sprocket units 84 and 86. The chain sprocket units 84 and 86 rotatably drive their respective halves of the split shaft 80 and the auger unit connected thereon in either direction of rotation, the rotatable drive of each auger section being provided by the hydraulic motors 88 operatively connected to the chain sprocket units. The function of the auger 70 is to spread piles of concrete dumped on the roadbed site substantially evenly across the road bed to be laid as the machine advances along the road bed. The hydraulic motors are reversable and are driven by hydraulic fluid supplied through hoses or pipes (not shown) connected to the hydraulic fluid pump or reservoir. The direction of flow of the hydraulic fluid and hence the direction of rotation of hydraulic motors 88 is controlled in the known and conventional manner by valves operated by two of the manual levers 73 on the control console 64.

Immediately following the auger 70 is a horizontally elongated, vertical strike off plate 90 fixedly or adjustably connected to and extending between the chain sprocket units 84 and 86. This strike off plate levels off the wet concrete spread by the auger 70 at the depth desired, the excess concrete piling up against the face of the strike off plate 90. The strike off plate 90 levels the slab of wet concrete at a rough depth sufficient to provide the ultimate desired thickness or elevation of the upper surface of the concrete strip being laid.

Both the auger 70 and the strike off plate 90 are supported by forwardly extending arms 92 and 94, which in turn are pivotally supported by stub shafts 96 and 98 on the frame structures (hereinafter described) for the track means 22 and 24. Suitable hydraulic or mechanical articulation means (not shown) may be used to pivot arms 92 and 94 for raising or lowering the auger 70 and strike off plate 90.

As the machine travels forwardly, the auger 70 and strike off plate 90 leave behind a slab of wet concrete which needs to be further worked to provide the requisite concrete properties, finish and shape for the roadway. The main frame 26 has supported thereon between it and the strike off plate 90 a ganged vibrator unit 110 comprising a horizontal bar or beam 112 extending between arms 92 and 94. The beam or bar 112 has supported thereon at regularly spaced intervals a plurality of electrically powered concrete vibrators 114, the horizontal, lower ends of which dip into and travel through the wet concrete slab to work the concrete and its aggregate. The vibrators are each connected to the coupler boxes 116, which have electrical connectors or couplers 118 for the wire connection between the coupler boxes and the vibrators 114.

The bar 112 may further have supported thereon plates 120 and 122. Such plates may be heavy gauge sheet metal oriented in the vertical plane and having a size sufficient to function as fins or baffles. Such fins or baffles preferably are located about midway between the vibrators 114.

The ganged vibrator unit 110 is coupled to the frame by hydraulic cylinder articulating units 124 and 126. The hydraulic cylinder members raise and lower the vibrators 114 and the bar 112, the bar 112 being supported by any expedient mechanism.

A tamper bar 128 extends laterally across the front of the frame 26. It is reciprocated into and out of the concrete layer just ahead of the frame by cranks 130 and 132. Details for such mechanisms may be found in my U.S. Pat. No. 3,377,933, which is incorporated herein by reference. The cranks are driven by shaft 136 rotatably journalled in bearings 134 and 138.

A crown pan 150 lies beneath the frame 26. This crown pan functions to level and smooth the strip of wet concrete in the configuration desired. The crown pan is mounted by mechanism shown in my U.S. Pat. No. 3,377,933, disclosure of which is incorporated herein by reference, so that it can be set at the desired elevation and provided with an arch or crown, if desired.

The rear plate 152 attached to the frame member 46 has mounted thereon solenoid valve units 154 and 156, such units being a part of the hydraulic system hereinafter described.

A torsion bar 160 (FIG. 1) extends from front to rear of the frame 26. The front end of the torsion bar 160 is rigidly secured to the frame tube 44 by an angle iron or bracket member 162. The torsion bar comprises a tube rigidly secured to the member 162 and a rod 168. One end of rod 168 is fixedly secured in the end of the tube 166. The rod 168 is pivotally supported in the bearing or sleeve 164, which is mounted on the frame tube 46 by the angle iron bracket 172.

The tube remote end of the rod 168 projects slightly rearwardly of the frame tube 46. A vertical arm 175 is mounted on the projecting end of the rod 168. A plate is bolted to vertical arm 175, and a horizontal elongated bar or arm 178 is bolted to the plate.

When the torsion bar 160 is twisted clockwise or counterclockwise in response to twist of the frame 26, the arm or bar 178 is pivoted in a vertical plane. The torsion bar-remote end of the bar or arm moves either up or down. If desired, a vertical guide rod may be mounted on the rear frame member 46. The guide rod extends through an apertured guide plate in a manner allowing free pivotal movement of the arm 178 but prevents excessive front to rear displacement of arm 178.

A bracket is mounted on the free end of the arm 178. It carries a vertical thumbscrew which may be adjusted vertically. The lower end of the thumbscrew bears on a strike bar secured to one end of the pivot arm 192. The pivot arm 192 is supported by shaft 194 in a housing 198 of an electrical sensor unit 196. Such units are commercially available and are known in the art. The arm 194 may have counterweights and/or may be spring loaded to urge arm 192 to rotate in the clockwise direction.

The sensor unit has in the housing 198 electrical switch means (not shown) which sense pivotal movement of the arm 192 and shaft 194 in either the clockwise or counterclockwise direction. The sensor unit is set so that the switch means is open or non-functioning when the frame 26 has no twist. This may be done conventionally by adjustment of the thumbscrew. Upon pivotal movement of the arm 178 and the arm 192 in either direction, the switch means of the sensor unit sends an electrical signal to the control unit 68. The latter in turn, as hereinafter described, operates hydraulic cylinder 28 to raise or lower its corner of the frame 26 in a twist-relieving direction. Further details of the torsion bar and its mechanical connection to the sensor unit 196 are set forth in my U.S. Pat. No. 3,905,715, particularly in reference to FIGS. 1, 7, 8 and 9 thereof.

The front frame tube 44 carries a front strike-off plate against which the wet concrete accumulates just prior to the smoothing and shaping of the concrete beneath the crown pan. The tamper bar 128 works the concrete just ahead of and slightly below the strike-off plate. Details of the strike-off plate and the crown pan structure are described in my aforesaid U.S. Pat. No. 3,377,933.

Each track means 22 and 24 comprises a track frame 210. Such track frame comprises a pair of elongated, horizontal, heavy frame plates 212 and 214. These plates in turn are rigidly connected to a pivot bearing 216, which rotatably journals a shaft 218 extending from the bearing 216 toward and beyond the side frame tube 42 (and 40).

The shaft 218 is connected to an arm 220 which is pivotable relative to the shaft. The arm 220 extends horizontally beneath the frame tube 42 in a rearward direction to a rear pivot bearing 221, hereinafter described.

The lower end of the hydraulic cylinder 224 of the front hydraulic cylinder members 28 and 32 are mounted by bracket members 222 attached to the arm 220. Thus, the lower end of these hydraulic cylinders have rigid interconnection with the arm 220 and also the respective track means 22 and 24. The upwardly extending piston rod 226 of each hydraulic cylinder is connected by a pivot joint to a bracket 232 rigidly connected by brace plate 230 to the forward end of the respective frame tube 42 and 44. Thus, the front of the frame 26 is "floatingly" supported relative to the track members 22 and 24 solely by the two hydraulic cylinder members 28 and 32.

The track means 22 and 24 are connected near the rear ends thereof by a slide bearing 236 to the sides of the frame 26. This track bearing allows the frame 26 to move up and down relative to the tracks but restrains the tracks from separating from the frame in a lateral direction. The slide bearing 236 comprises vertical channels 238 and 240 mounted on the plate 242 to form a vertical channel structure. The plate 244 is bolted to each track frame 210. A T-bar 246 is rigidly attached to the arm 220 and matingly fits in the channel to form the slide bearing. Such bearing has a minor amount of lateral play to permit the frame 26 to move relatively freely in a vertical direction relative to each of the track members.

The frame 26 and the components mounted thereon are drawn forwardly by the track means 22 and 24 via the arm 220. The front end of the arm 220 is connected to each track means via the bearing 216 which is rigidly connected to the track means. The rear end of the arm 220 is connected to the rear cross frame 46,152 by the bearing 221, which is rigidly mounted on the rear plate 152 and pivotally connected to the rear end of the arm 220. The vertical restraining bar 237 is fixedly attached to the side frame 42 and extends downwardly along the outer side of the arm 220. This restrains the forward end of the arm 220 and aids in keeping the respective track means from drawing away from the frame 42. It relieves pressures which would otherwise be imposed upon the bearings 216 and 221.

The electrical and hydraulic system of the machine is illustrated principally in FIGS. 10 and 11 of my U.S. Pat. No. 3,905,715. The hydraulic system includes a pump driven by the power plant 62. The pump has a return line and an output or pressure line.

A pair of solenoid valve units 154,156 are mounted on the rear plate 152. A hydraulic line connects their solenoid valves with the hydraulic pressure system. One solenoid valve of the unit 156 is connected by hydraulic hoses to the hydraulic cylinder of the hydraulic cylinder member 34. The solenoid valve permits hydraulic fluid flow in either direction through the hoses so that the piston of the member 34 may move up or down, the control of which is determined by the solenoid valve. Similarly the other solenoid valve is coupled by hydraulic hoses to the hydraulic cylinder of the hydraulic cylinder member 32, the piston movement of which is controlled in the same manner.

The hydraulic cylinders 28 and 30 on the opposite side of the frame are activated through similar solenoid valves. One solenoid valve of the unit 154 is connected by hydraulic hoses to the rear cylinder member 30. The other solenoid valve 280 is connected by hydraulic hoses to the front cylinder member 28.

When the solenoid valves are in the closed or inactive position, hydraulic fluid is cycled between the pump and the hydraulic fluid reservoir 69. The pump has a built in bypass and the solenoid valves have about a 20 percent leakage, a design parameter of the quick opening function of this particular type of valve.

A hydraulic line forms with another hydraulic line, a hydraulic pressure line loop connected by branch lines to each solenoid valve whereby hydraulic fluid may flow in either direction from the hydraulic hoses through the valve—depending on the setting of the valve.

Referring to FIG. 1, the machine has mounted along the side of one of the tracks three stringline followers 300, 302 and 304. These stringline followers are of the same construction as the sensor unit 196 with the exception that the arm 192 carries a rod 306 which bears against the stringline as the machine moves forwardly. These types of follower and sensor units are known in the art and are commercially available.

The follower-sensor units 300, 302 and 304 are connected by wires (not shown) to the control unit 68. The solenoid valves are connected by wires to the control unit 68.

An additional control member preferably is included in the machine. It is a slope control member 314 mounted on the frame 26. Such slope control member comprises a pendulum or mercury switch connected by wires to the control unit 68. Additionally, the sensor unit 196 is connected by wires to the electrical control unit.

The path or direction of forward movement of the machine is controlled by sensor unit 304, the feeler 306 of which bears against the side of the stringline 308. Each track 22 and 24 is separately driven by its own hydraulic motor. The control unit 68 and follower sensor unit 304 control, in a manner known in the art, the rate of drive and direction of each hydraulic motor for the two tracks and automatically make corrections in the drive for each track if the sensor feeler moves from its zero position against the stringline, i.e., caused by variation of the path of direction of the machine relative to the stringline to the right or left as the machine moves forwardly.

The sensor feelers 306 of the stringline follower control units 300 and 302 ride against the top or bottom of the string line and are spring loaded thereagainst. When these followers move from zero position, they trigger an electro-hydraulic command via the control unit 68 which causes, via the solenoid valves, the hydraulic cylinder members 32 and 34 to be motivated. The sensor unit 302 controls movement of the hydraulic cylinder member 32 in a manner keeping the frame 26 and all members supported thereon at an elevation corresponding to that of the stringline. The sensor unit 300 performs the same function relative to the hydraulic cylinder member 34.

Thus, as viewed in FIG. 1, the elevation of the right side of the frame 26 is controlled through the sensor units 300 and 302 and hydraulic cylinder members 34 and 32 in a manner whereby the right side of the frame maintains an elevation corresponding to that of the stringline directly opposite the right side of the frame. Thus, the depth of the concrete and the elevation of its upper surface left behind the machine has a constant, predetermined elevation relative to the stringline.

The left side of the frame has its elevation relative to the stringline controlled via other control members. The slope control member 314 controls, via control unit 68, the hydraulic cylinder 30. This slope control unit is thus settable, or has an auxiliary control on the control unit 68, for presetting a zero slope or inclined slope for the left hand of the frame relative to the righthand side. Assuming a zero slope is set, the slope control member 314 and the auxiliary electrical and hydraulic connections, heretofore described, will issue hydraulic fluid flow commands to the cylinder 30 for maintaining the left, rear corner of the frame at the same elevation as the elevation of the right rear corner of the frame. If the roadway being poured has a crown or pitch, e.g., for water runoff, banking in curves, etc., a setting of the slope control switch provides the specified crown or pitch for that segment of the roadway being laid.

The hydraulic cylinder member 28 at the front left corner of the machine is controlled by the torsion bar and its associated mechanism via the sensor unit 196 and the control unit 68. The objective is to keep the front left corner of the machine at the same elevation as the rear left corner of the frame. If the forward end of the track 22 drops, the frame 26 will twist accordingly. This registers a twist in the torsion bar 160, which in turn causes through the electrical and hydraulic system heretofore described a corrective action by the hydraulic cylinder member 28, i.e., a raising of the front lefthand corner of the frame until a frame twist is relieved. Similarly, when the front end of the left track 22 rises, the twist imparted to the frame 26 results in a lowering of the front left corner of the frame 26 by the hydraulic cylinder member 28.

When the front of the right track 24 drops, the right front hydraulic cylinder member 32 raises the right front corner of the frame to maintain it at the stringline-controlled elevation. This registers a twist in the frame 26 similar to that described above when the front of the left track 22 drops. Through the torsion bar control, hydraulic cylinder member 28 raises the left front corner of the frame an amount corresponding to the rise of the right front corner of the frame. As the machine progresses forwardly, the feeler sensor unit 300 will detect a drop in the rear portion of the right track 24 and raise the right rear corner of the frame 26 via hydraulic cylinder member 34 correspondingly. The slope control unit will cause a corresponding rise via hydraulic cylinder member 30 of the left rear corner of the frame.

Through the joint functioning of the hydraulic control cylinders, the righthand side of the frame 26 and also the righthand side of the crown pan 150 remains at a constant vertical distance below the stringline immediately to the right thereof. The lefthand side of the frame 26 and the crown pan therebetween are also maintained at a constant vertical distance below the horizontal plane of the stringline, which distance may be the same as or different from the righthand side of the frame and pan—depending on the setting of the slope control unit 314.

When the machine travels over irregular or rough terrain in movement to or from the road bed, between different points along the road bed, etc. it is preferred to deactivate the controls for regulating the movement of the hydraulic cylinder members 30, 32 and 34. Through check valves or other suitable means, these cylinders may be locked hydraulically with the frame, preferably half-raised relative to the tracks. The torsion bar-activated control system for the cylinder member 28 remains activated as the machine is driven. It thereby functions continually to relieve twist strain in the frame 26 which would otherwise be imparted thereto as the two tracks traverse the uneven terrain. The machine is even capable of crossing ditches without severe twist strain on the frame 26 by approaching the ditches diagonally or at right angles thereto.

The slip forms for the machine are shown in FIG. 1. They comprise right and left vertical, horizontally elongated, form plates 330 and 332 which are bolted or otherwise fixedly attached to the respective track frames. Forwardly thereof there are winch housings 334 and 336.

The slip form plates 330 and 332 extend rearwardly from the housings 334 and 336 to a point approximating the front edge of the crown pan 150. At this point, two additional form plates, attached to the sides of the pan 150, become the side slip forms. The form plates 330 and 332 preferably overlap the form plates on the pan in a manner precluding escape of concrete between the overlapped portions.

Figure 3:
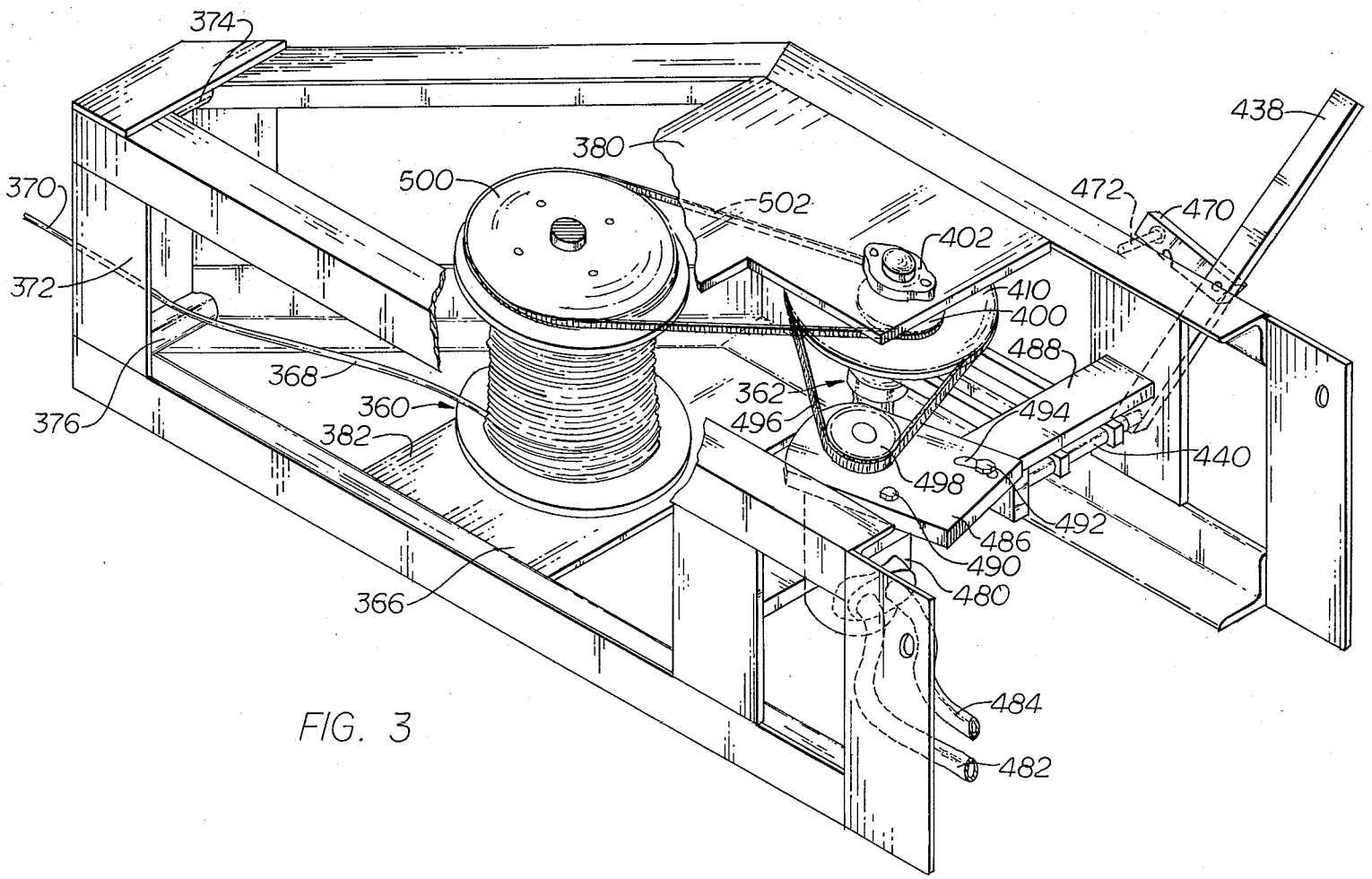
FIG. 3 is a fragmentary, perspective view of a winch, its cable and motor in its mounting well on the forward corner of said machine.

Referring to FIG. 3, in particular, a winch 360, its clutch drive 362 and its hydraulic drive motor 364 are mounted in each housing 334,336. The front of each trapezoidal housing has a rectangular opening 372 for passage of the cable 370. Fixed rods or rollers 374,376 absorb cable pressures, and provide wear surfaces, should the cable touch the upper or lower edges of opening 372.

Each housing 334,336 is formed by the inner wall 338, the diagonal wall 340, and the rearwardly extending, outer wall 342. The housings have a top wall 344 having two, hinged access doors 346,348.

The frame for each housing 334,336 is a rugged, hollow, trapezoidal frame made of interwelded angle iron and flat steel plates (cf., FIG. 3). The housings must not only be strong enough to mount the winch 360 and its clutch drive 362, but it must also be strong enough to withstand the forces which it carries when the cable 370 is used for pulling its side of the paving machine forwardly. Being of conventional construction, the frame parts of the housings 334, 336 are not described in detail—except where relevant to mounting parts of the respective winches 360 and their drive components. An upper, L-shaped winch and clutch mounting plate 380 and a lower, winch mounting plate 382 give the enclosure 366 the requisite lateral strength and twist resistance.

Referring to FIGS. 3 and 5–8, the clutch 362 is a positive drive, non-slip, butterfly-type clutch. A lower, flanged bearing assembly 390 is attached to the mounting plate 384. The lower end 394 of the vertical shaft 396 is rotatably supported by the bearing 392 in the assembly 390. The hub 398 of the winch drive sprocket 400 is secured to the shaft by the keyway spline 406. The upper end 406 of the shaft 396 is rotatably journalled by the bearing 404 in the upper, flanged bearing assembly 402, which is attached to the upper mounting plate 380.

The hub 408 of the clutch's driven sprocket 410, which is driven by the chain 496, is rotatably mounted about the shaft 396. It is rotatably driven by the non-slip, positive drive clutch 412, the female component 414 of which is welded concentrically to the underside of the sprocket 410. The male component 416 of the clutch is welded to the sliding fulcrum 418, which is slidably and non-rotatably mounted on the shaft by the key spline fitted in the longitudinal keyway slot 421 in the shaft. The sliding fulcrum rests on a coil spring 420 mounted around the shaft on the flat washer 422. The spring urges and holds the male component 416 in its engaged position (shown in FIG. 5) in the female component 414 of the clutch 412. The male component 416 is mounted about a collar 424 attached to the shaft 396 by the roll pin 426.

The sliding fulcrum 418 has a peripheral groove 430. A yoke 432 is slidably engaged in the groove. It is pivotally attached by the pin 434 to an end of the pivot arm 436, the other end of which is fixedly attached to the arm 438, both of which arms are pivotally supported by pin 440 to the upper end of the upstanding standard 442. The latter is welded to the mounting plate 384. The clutch 412 is engaged and disengaged by pivoting the arm 438, which raises and lowers the sliding fulcrum and the clutch's male component 416 into and out of engagement with the female component 414.

The hub 408 of the sprocket 410 is rotatably supported about the shaft 396 by the bearing 444. The hub has a grease fitting 446. Flat washers 446 between the hub 408 and clutch's drive sprocket 400 are used as required as shims to attain desired alignment drive sprocket.

Figure 6:
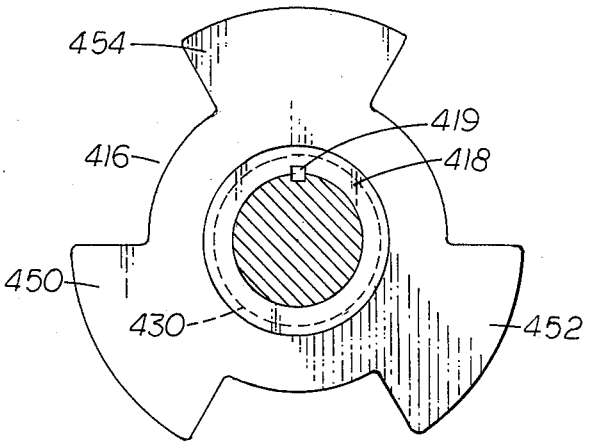
FIG. 6 is a plan view of the engageable, shift-slidable butterfly of the clutch assembly.
Figure 7:
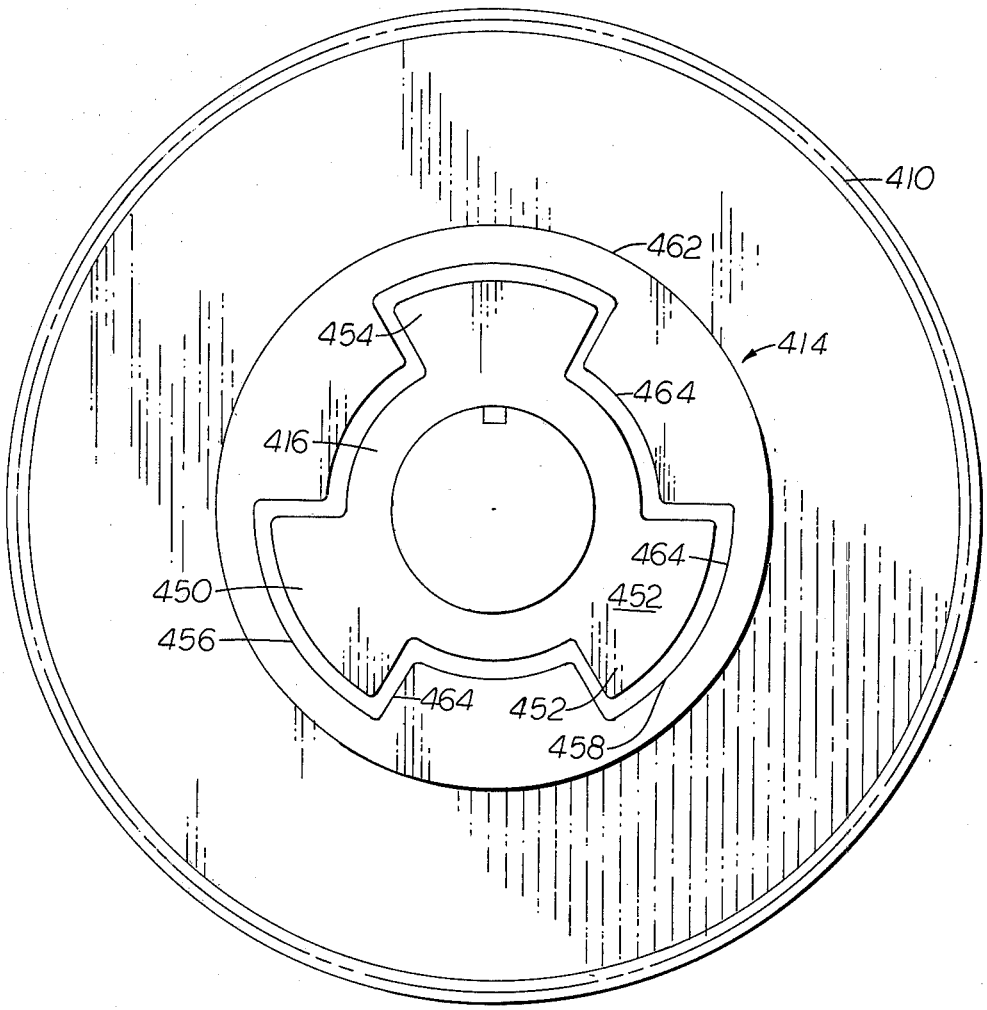
FIG. 7 is a plan view of said butterfly engaged in the butterfly hub of the winch drive sprocket.
Figure 8:
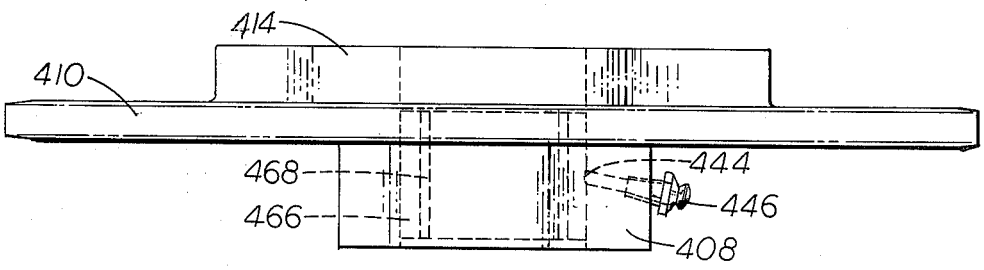
FIG. 8 is a side elevation of the sprocket in FIG. 7.

The clutch's male and female components are illustrated in plan view in FIGS. 6 and 7. The radial butterfly lands or ears 450, 452, 454 of the male component 416 matingly fit and interlock in the similarly shaped, radial recesses 456,458,460 of the female component 414. The recesses are machined in the ring 462 which is welded to the underside of the sprocket 410. The clearances 464 are in the order of ¼". FIG. 8 shows the weldment of the female clutch component 114 and the sprocket 410 and its hub 408. The bearing 444 is composed of the needle bearing 466 and inner race 468.

Referring again to FIG. 3, the arm 438 is shown in the clutch-engaged position. It has a rigid arm 470 attached thereto. The arm 470 carries a slidable pin 472, which when projected as shown in FIG. 3, extends over the housing and prevents arms 438,470 from pivoting counterclockwise (as viewed in FIG. 3). This holds the arm 438 in the clutch-engaged position. When pin 472 is retracted, the arm 438 can be pivoted counterclockwise to disengage the clutch.

The hydraulic motor 480 (FIG. 3) for each winch 360 is a reversible motor driven by hydraulic fluid pumped in either direction through hydraulic fluid lines 482,484. The motor is hung on motor-mounting plate 486, which in turn is pivotally mounted on the cross-bar 488 by bolts 490 and 492. The latter, when loosened, allows the plate 486 to pivot thereabout with loosened bolt 492 moving in the curved slot 494. This arrangement allows for swinging arm 486 to either loosen or tighten the tension in drive chain 496, which is mounted on the sprocket 498 of the hydraulic motor 480 and the sprocket 410 of the clutch. When the clutch is engaged, the drive sprocket 400 drives the winch sprocket 500 via chain drive 502. The direction of rotation of the winch 360 is determined by the selected, controllable direction of rotation of the hydraulic motor 480.

To illustrate uses of the cable/winch auxiliary drives, let it first be assumed that the paving machine has been widened by adding sections therein between the tracks 22,24. The load of wet concrete ahead of the machine is so large that one or both tracks 22,24 begins to slip. The machine bogs down under load. Valves 510,512 are opened, and fluid is supplied to unwind both cables 470 from their respective winches. Both cables are secured to a fixed or heavy object ahead of the machine. The winches are rotated in the reverse direction to draw the cables tight. As can be seen in FIG. 2, the hydraulic drive motor M for the track and the hydraulic lines 510,512 are coupled to the hydraulic fluid supply line by T-couplings. This enables the track motors M and the winch motors 480 on each respective side to work synchronously in propelling the machine forwardly under stringline control. Both tracks 22,24 and both winches 360 move the machine forwardly.

Since each hydraulic motor for the winch drives and for the track drives allows for bypass of hydraulic fluid when the motor is under load, the left hand track and left hand winch and the right hand track and right hand winch work synchronously under the guidance of the stringline steering control unit 304 to move the machine forwardly in the stringline-set paving path.

Next, let it be assumed that the hydraulic system or the mechanical drive components for the right hand track have malfunctioned, and the track is disabled. Lying ahead of the machine is one or more piles of dumped, wet concrete to be spread and formed by the machine. The machine crew can quickly disconnect the mechanical drive of the disabled track, e.g., by removal of a sprocket drive chain, a gear, etc., so that the track can move free of resistance by its hydraulic and mechanical drive components. The shut-off valves 510, 512 in the hydraulic lines 482, 484 are opened, and the winch is driven rotatably to play out cable 370 ahead of the machine. The cable is attached, ahead of the machine, to a fixed or heavy object, and is then drawn taut. The winch drive is now ready to perform the forward drive of the right-hand side of the machine.

The right-hand winch drive and the left track work synchronously under the control of the stringline feeler 304 in keeping the machine moving forwardly under the guidance of the stringline in essentially the same manner as with controlled, forward propulsion from two operational tracks or two operational tracks plus two auxiliary winch drives. This temporary drive combination can be continued until the wet, dumped concrete is spread and formed, until the end of a work shift or even for days if necessary.

Figure 4:
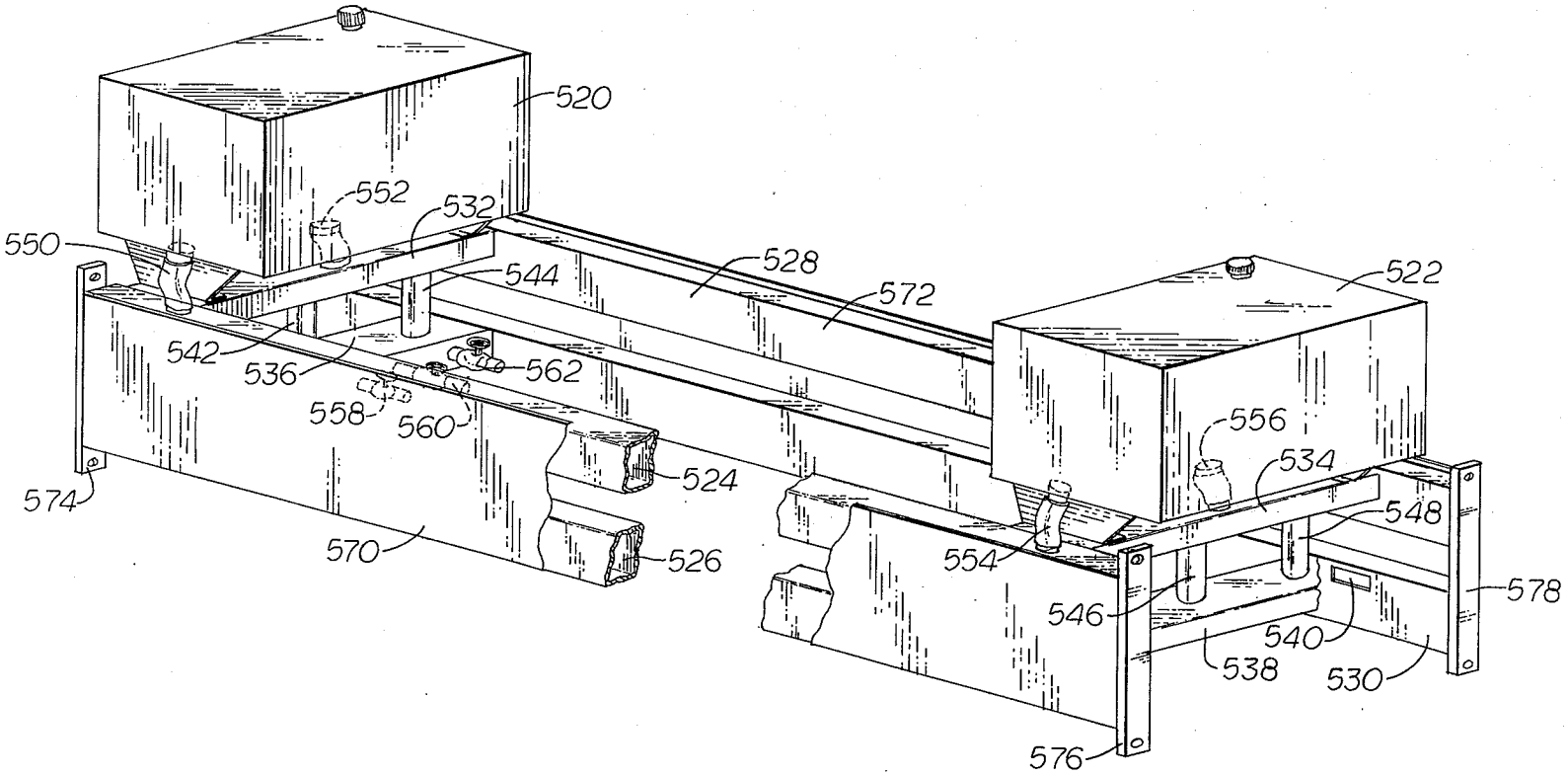
FIG. 4 is a schematic view of the paving machine's hollow frame members which serve as hydraulic fluid reservoirs and the hydraulic connections between frame tubes and the hydraulic reservoir tanks.
Figure 5:
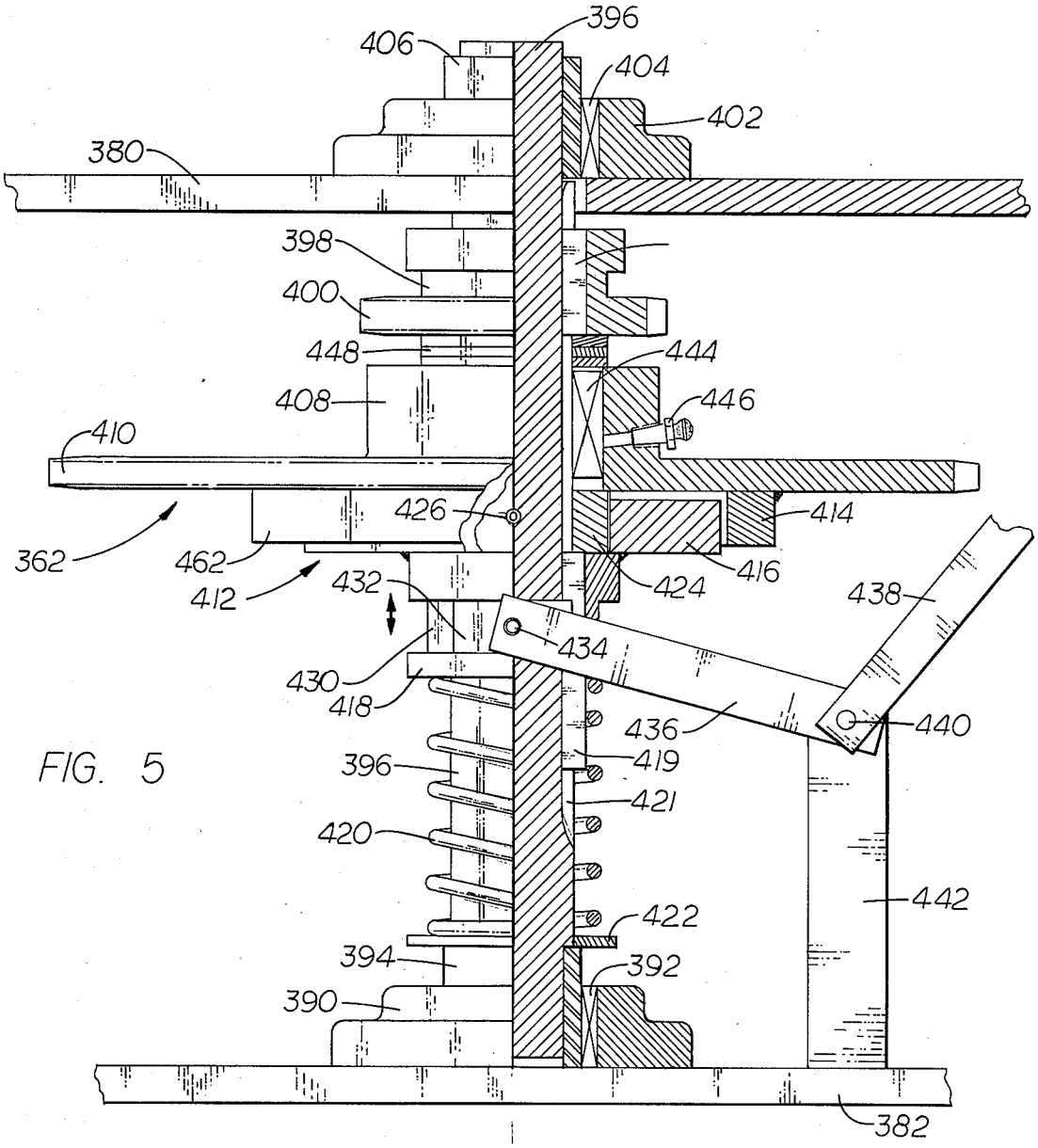
FIG. 5 is a side elevation, partly in radial section, of a clutch assembly for the winch drive.

The use of hollow frame members as reservoir and cooling chambers for the hydraulic fluid is illustrated in FIG. 4. The machine has two hydraulic fluid tanks 520,522 mounted on the frame. The frame comprises a pair of front, rectangular tubes 524,526; a pair of rear, rectangular tubes 528,530; a pair of upper, cross, rectangular tubes 532,534; and a pair of lower, cross, rectangular tubes 536,538. The ends of tubes 524,526, 528 and 530 are sealed. The ends of upper, cross tubes 532,534 and of lower, cross tubes 536,538 are welded to tubes 524,528 and 526,530, respectively. Each of the latter four tubes has openings or ports 540 for flow of hydraulic fluid into and out of the respective ends of the cross tubes.

Cross tubes 532,536 and cross tubes 534,538 are also in fluid flow communication via vertical tubes 542,544 and vertical tubes 546,548, respectively. Hydraulic fluid enters and leaves the tanks 522,524 via tubular connectors 550,552 and 554,556, which in turn communicate with the front, upper frame tube 524 and a cross frame tube 532 or 534. This gives a system in which hydraulic fluid can circulate and cool before it is pumped via the valved connectors 558,560,562 on the lower, cross tube 536 to the various hydraulic-fluid-operated parts of the paving machine.

The front tubes 524,526 may have a front plate 570 welded thereon, as may also be the case with rear plate 572 welded to the rear tubes 528,530. The ends of the front and rear frame assemblies have welded thereon vertical bars 574, 576,578, which are used to bolt thereon additional frame sections used to widen the paving machine and to mount the frames for the tracks 22,24 on the tubular frame assembly.

The use of the tubular frame members as hydraulic fluid reservoirs and heat exchangers provides large, air cooled surfaces which keep the hydraulic fluid temperature at a maximum of about 150° F. With hydraulic systems without the tubular frame reservoir and heat exchangers, cf., my U.S. Pat. No. 3,905,715, hydraulic fluid maximum temperatures in the order of 140°-150° F. are relatively common while the machine is laying pavement.

It will be appreciated from the foregoing that the invention herein can take many forms other than the preferred forms shown in the drawings and that the invention as herein claimed is not limited to the illustrated embodiments. For example, instead of using a slope control, the elevation of the left side of the frame may be controlled off a second stringline by a stringline feeler like the unit 300, which is mounted near the rear of the main frame on the left side thereof. The torsion bar still controls the elevation of the left, front corner of the frame.

I claim:

1. A paving machine comprising a frame, means on said frame for spreading and working wet concrete into a strip of wet concrete pavement, at least one endless track on each side of said frame for supporting said frame and the machine components mounted thereon, power drive means including a hydraulic motor for driving at least one track on each of said frame to propel said machine forwardly, a pair of cable winches mounted on respective opposite sides of the forward portion of said machine, a hydraulic motor for driving each winch, a first hydraulic line circuit for supplying hydraulic fluid under pressure to one of the track's hydraulic motor and also the one winch's hydraulic motor on the same side of said machine either simultaneously or individually, and a second hydraulic line circuit for supplying hydraulic fluid under pressure to another track's hydraulic motor and also the other winch's hydraulic motor on the opposite side of said machine either simultaneously or individually, whereby, when cables on one or both respective winches are unwound and secured ahead of said machine, the machine may be propelled forwardly by the tracks alone, the track and winch on one side of said machine and the track alone on the opposite side of said machine, the tracks and winches on both sides of said machine, or the track alone or together with the winch on one side of the machine and the winch alone on the opposite side of the machine.

2. A paving machine as claimed in claim 1, wherein each of said hydraulic line circuit circuits contains valve means for selectively shutting off flow of hydraulic fluid under pressure to the track's hydraulic motor and to the winch's hydraulic motor.

3. A paving machine as claimed in claim 2, and hydraulic fluid flow control means for metering the rate of hydraulic fluid flow in each of said hydraulic line circuits to speed up or slow down said rate of hydraulic fluid flow in one or both circuits and thereby steer the machine by the hydraulic fluid flow rate through the respective hydraulic motors which are being driven by the hydraulic fluid.

4. A paving machine as claimed in claim 3, and string-line feeler means operatively associated with said hydraulic fluid flow control means to effect steering of said machine in a path parallel with said string-line.

5. A paving machine as claimed in claim 1, and a mechanical drive coupling each winch with its hydraulic motor, each drive including a disengageable, non-slip, mechanical clutch.

6. A paving machine as claimed in claim 5, wherein each clutch has a clutch plate with radial wings removably engageable in an opposing clutch plate having radial wing recesses adapted to receive said radial wings to provide non-slip engagement of said clutch plates.

7. A paving machine as claimed in claim 6, a drive shaft rotatably drivably coupled to said hydraulic motor for said winch, one of said clutch plates being fixed to said shaft for rotation therewith and the other of said clutch plates being rotatable about said drive shaft, and means mechanically coupling said other of said clutch plates to said winch for rotatably driving same.

8. A paving machine as claimed in claim 7, wherein said one of said clutch plates is splined on said shaft for limited longitudinal movement along said shaft toward and away from said other of said clutch plates into and out of driving engagement therewith, and means for moving and holding said one of said clutch plates in and out of said driving engagement.

9. A paving machine comprising a frame having a plurality of hollow, sealed frame members, power driven means on said frame for spreading and working wet concrete into a strip of wet concrete pavement, means for supporting said frame and the machine components mounted thereon and for propelling said machine forwardly, a hydraulic fluid circuit on said machine, including a hydraulic fluid reservoir tank, a hydraulic fluid pump for pressurizing said fluid, a plurality of hydraulic motors on said machine, and a plurality of hydraulic lines coupling said tank, pump and motors for circulation of pressurized hydraulic fluid through said motors, characterized by hydraulic fluid flow means coupling said hydraulic fluid circuit with said hollow, sealed frame members for circulation of pressurized hydraulic fluid through said frame members to cool the hydraulic fluid and provide auxiliary reservoir volume for said fluid in said circuit.

10. A paving machine as claimed in claim 9, wherein said machine also has a plurality of hydraulic cylinders coupled with said hydraulic fluid circuit and operated by the pressurized hydraulic fluid in said circuit.

* * * * *